US009009036B2

(12) United States Patent
Valin et al.

(10) Patent No.: US 9,009,036 B2
(45) Date of Patent: Apr. 14, 2015

(54) METHODS AND SYSTEMS FOR BIT ALLOCATION AND PARTITIONING IN GAIN-SHAPE VECTOR QUANTIZATION FOR AUDIO CODING

(75) Inventors: Jean-Marc Valin, Montreal (CA); Timothy B. Terriberry, Mountain View, CA (US)

(73) Assignee: Xiph.org Foundation

( * ) Notice: Subject to any disclaimer, the term of this patent is extended or adjusted under 35 U.S.C. 154(b) by 304 days.

(21) Appl. No.: 13/414,490

(22) Filed: Mar. 7, 2012

(65) Prior Publication Data

US 2012/0232913 A1 Sep. 13, 2012

Related U.S. Application Data

(60) Provisional application No. 61/450,053, filed on Mar. 7, 2011.

(51) Int. Cl.

| | |
|---|---|
| ***G10L 19/02*** | (2013.01) |
| ***G10L 19/038*** | (2013.01) |
| *G10L 19/002* | (2013.01) |

(52) U.S. Cl.

CPC ..... *G10L 19/038* (2013.01); *G10L 19/002* (2013.01)

(58) Field of Classification Search

CPC ..... G10L 19/038

See application file for complete search history.

(56) References Cited

U.S. PATENT DOCUMENTS

| | | | | |
|---|---|---|---|---|
| 5,079,547 | A | 1/1992 | Fuchigama et al. | |
| 5,778,339 | A * | 7/1998 | Sonohara et al. | 704/224 |
| 5,845,241 | A | 12/1998 | Owechko | |
| 5,960,388 | A * | 9/1999 | Nishiguchi et al. | 704/208 |
| 5,983,172 | A * | 11/1999 | Takashima et al. | 704/203 |
| 6,018,707 | A * | 1/2000 | Nishiguchi et al. | 704/222 |
| 6,064,954 | A * | 5/2000 | Cohen et al. | 704/207 |
| 6,463,097 | B1 | 10/2002 | Held et al. | |
| 6,567,777 | B1 | 5/2003 | Chatterjee | |
| 6,934,676 | B2 | 8/2005 | Wang et al. | |
| 6,993,477 | B1 | 1/2006 | Goyal | |
| 7,242,976 | B2 | 7/2007 | Minato | |
| 7,275,036 | B2 | 9/2007 | Geiger et al. | |
| 7,343,287 | B2 | 3/2008 | Geiger et al. | |
| 7,447,631 | B2 | 11/2008 | Truman et al. | |
| 7,454,330 | B1 * | 11/2008 | Nishiguchi et al. | 704/224 |
| 7,483,836 | B2 | 1/2009 | Taori et al. | |
| 7,583,804 | B2 | 9/2009 | Suzuki et al. | |

(Continued)

OTHER PUBLICATIONS

Valin et al., "Constrained-Energy Lapped Transform (CELT) Codec", IETF Internet Draft, Jul. 4, 2009.*

(Continued)

*Primary Examiner* — Brian Albertalli

(74) *Attorney, Agent, or Firm* — Dergosits & Noah LLP; Todd A. Noah

(57) ABSTRACT

Embodiments are generally directed to systems and methods for bit allocation and band partitioning for gain-shape vector quantization in an audio codec. An audio codec implements a method that uses an implicit, dynamic scheme to allow an encoder and decoder to recreate a series of bit allocation decisions for gain and shape without transmitting additional side information for each decision, based on the number of bits that are left remaining and available in a given packet. For implementation in practical codecs, the band comprising the allocation of bits for the shape is recursively split into equal partitions until the number of bits allocated to each partition is less than the maximum codebook size.

21 Claims, 5 Drawing Sheets

(56) References Cited

U.S. PATENT DOCUMENTS

| | | | | |
|---|---|---|---|---|
| 7,630,882 | B2 * | 12/2009 | Mehrotra et al. | 704/205 |
| 7,761,290 | B2 | 7/2010 | Koishida et al. | |
| 7,979,271 | B2 * | 7/2011 | Bessette | 704/219 |
| 8,195,730 | B2 | 6/2012 | Geiger et al. | |
| 8,364,471 | B2 | 1/2013 | Yoon et al. | |
| 8,463,599 | B2 | 6/2013 | Ramabadran et al. | |
| 8,494,863 | B2 | 7/2013 | Biswas et al. | |
| 8,554,818 | B2 | 10/2013 | Zhang et al. | |
| 8,620,674 | B2 | 12/2013 | Thumpudi et al. | |
| 2005/0216262 | A1 | 9/2005 | Fejzo | |
| 2006/0031064 | A1 | 2/2006 | Liljeryd et al. | |
| 2007/0016405 | A1 | 1/2007 | Mehrotra et al. | |
| 2007/0040710 | A1 | 2/2007 | Tomic | |
| 2007/0063877 | A1 | 3/2007 | Shmunk et al. | |
| 2007/0211804 | A1 | 9/2007 | Haupt et al. | |
| 2007/0282603 | A1 | 12/2007 | Bessette | |
| 2008/0010064 | A1 | 1/2008 | Takeuchi et al. | |
| 2008/0031463 | A1 | 2/2008 | Davis | |
| 2008/0033731 | A1 | 2/2008 | Vinton et al. | |
| 2008/0126104 | A1 | 5/2008 | Seefeldt et al. | |
| 2008/0140393 | A1 * | 6/2008 | Kim et al. | 704/206 |
| 2010/0023336 | A1 | 1/2010 | Shmunk | |
| 2010/0286991 | A1 | 11/2010 | Hedelin et al. | |
| 2011/0035214 | A1 * | 2/2011 | Morii | 704/225 |
| 2011/0173012 | A1 | 7/2011 | Rettelbach et al. | |
| 2011/0178795 | A1 | 7/2011 | Bayer et al. | |
| 2011/0264454 | A1 | 10/2011 | Ullberg et al. | |
| 2012/0029924 | A1 * | 2/2012 | Duni et al. | 704/500 |
| 2012/0029925 | A1 * | 2/2012 | Duni et al. | 704/500 |
| 2013/0117028 | A1 * | 5/2013 | Kim | 704/500 |
| 2013/0218577 | A1 | 8/2013 | Taleb et al. | |

OTHER PUBLICATIONS

Valin, Jean-Marc, et al. "A high-quality speech and audio codec with less than 10-ms delay." Audio, Speech, and Language Processing, IEEE Transactions on 18.1 (2010): 58-67.*

Valin, Jean-Marc, Timothy B. Terriberry, and Gregory Maxwell. "A full-bandwidth audio codec with low complexity and very low delay." Proc. EUSIPCO. 2009.*

Kruger, H., et al. "On logarithmic spherical vector quantization." Information Theory and Its Applications, 2008. ISITA 2008. International Symposium on. IEEE, 2008.*

International Searching Authority, International Search Report and Written Opinion Jun. 4, 2012 (PCT/US12/28114).

International Searching Authority, International Search Report and Written Opinion May 30, 2015 (PCT/US12/28124).

International Searching Authority, International Search Report and Written Opinion Jun. 4, 2012 (PCT/US12/28120).

International Preliminary Report on Patentability dated Sep. 19, 2013 in PCT Application No. PCT/US2012/028114.

International Preliminary Report on Patentability dated Sep. 19, 2013 in PCT Application No. PCT/US2012/028120.

International Preliminary Report on Patentability dated Sep. 19, 2013 in PCT Application No. PCT/US2012/028124.

Valin et al. "A full-bandwidth audio codec with low complexity and very low delay." Proc. EUSIPCO, 2009.

Valin et al. "A high-quality speech and audio codec with less than 10-ms delay." Audio, Speech, and Language Processing, IEEE Transactions on 18.1 (2010): 58-67.

International Searching Authority, International Search Report and Written Opinion Feb. 2, 2012 (PCT/US11/52026).

* cited by examiner

DECODER 200

METHODS AND SYSTEMS FOR BIT ALLOCATION AND PARTITIONING IN GAIN-SHAPE VECTOR QUANTIZATION FOR AUDIO CODING

CROSS-REFERENCE TO RELATED APPLICATIONS

This application claims priority to provisional U.S. Provisional Patent Application No. 61/450,053, filed on Mar. 7, 2011 and entitled "Method and System for Bit Allocation and Partitioning in Gain-Shape Vector Quantization for Audio Coding," which is incorporated herein in its entirety.

COPYRIGHT NOTICE

A portion of the disclosure of this patent document including any priority documents contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

One or more implementations relate generally to digital communications, and more specifically to eliminating quantization distortion in audio codecs.

INCORPORATION BY REFERENCE

The present application incorporates by reference U.S. Patent Application No. 61/384,154, which is assigned to the assignees of the present application.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches.

The transmission and storage of computer data increasingly relies on the use of codecs (coder-decoders) to compress/decompress digital media files to reduce the file sizes to manageable sizes to optimize transmission bandwidth and memory use. Vector quantization is used in many signal compression applications. In general, a vector quantizer maps k-dimensional vectors in a vector space into a finite set of vectors $Y=\{y_i:i=1, 2, \ldots, N\}$. Each vector is called a code vector or a codeword and the set of all the codewords is called a codebook. In a codec, the encoder takes an input vector and outputs the index of the codeword that offers the lowest distortion. The lowest distortion is typically found by evaluating the Euclidean distance between the input vector and each codeword in the codebook. Once the closest codeword is found, the index of that codeword is sent through a channel, and is then replaced with the associated codeword. Gain shape vector quantization is a type of vector quantization method that has become widely used in high quality speech coding systems, and is generally used when it is important to preserve the energy of the vector.

Many existing low-delay audio codecs only support a limited number of frame sizes and bitrates, often hard-coding the dimensions and rates of the codebooks they use. This allows careful tuning of the rate allocation to various pieces of the codec, but is not very flexible. This lack of flexibility limits the ability of the codec to adapt to the variable capacity of modern network channels, and to trade off latency for quality and loss robustness. Moreover, with regard to gain shape vector quantization, present methods of determining bit rate allocations for the gain and shape quantizations require the solution of processor-intensive calculations that are not appropriate for use with low-power or fixed-point digital signal processors (DSPs).

What is needed, therefore, is an efficient system for bit allocation and band partitioning for use in an audio codec for gain-shape vector quantization operations.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Embodiments are generally directed to systems and methods for bit allocation and band partitioning for gain-shape vector quantization in an audio codec. The method uses an implicit, dynamic scheme to allow an encoder and decoder to recreate a series of bit allocation decisions without transmitting additional side information for each decision, based on the number of bits that are left remaining and available in a given packet. Since packet-switched networks for real-time communication must already convey the size of the packet, this side channel reduces the amount of explicit side information that must be transmitted, thus improving compression of the audio signal. For implementation in practical codecs, the band comprising the allocation of bits for the shape is recursively split into equal partitions until the size of each partition is less than the maximum codebook size.

Any of the embodiments described herein may be used alone or together with one another in any combination. The one or more implementations encompassed within this specification may also include embodiments that are only partially mentioned or alluded to or are not mentioned or alluded to at all in this brief summary or in the abstract. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Aspects of the one or more embodiments described herein may be implemented on one or more computers or processor-based devices executing software instructions. The computers may be networked in a peer-to-peer or other distributed computer network arrangement (e.g., client-server), and may be included as part of an audio and/or video processing and playback system.

Figure 1:
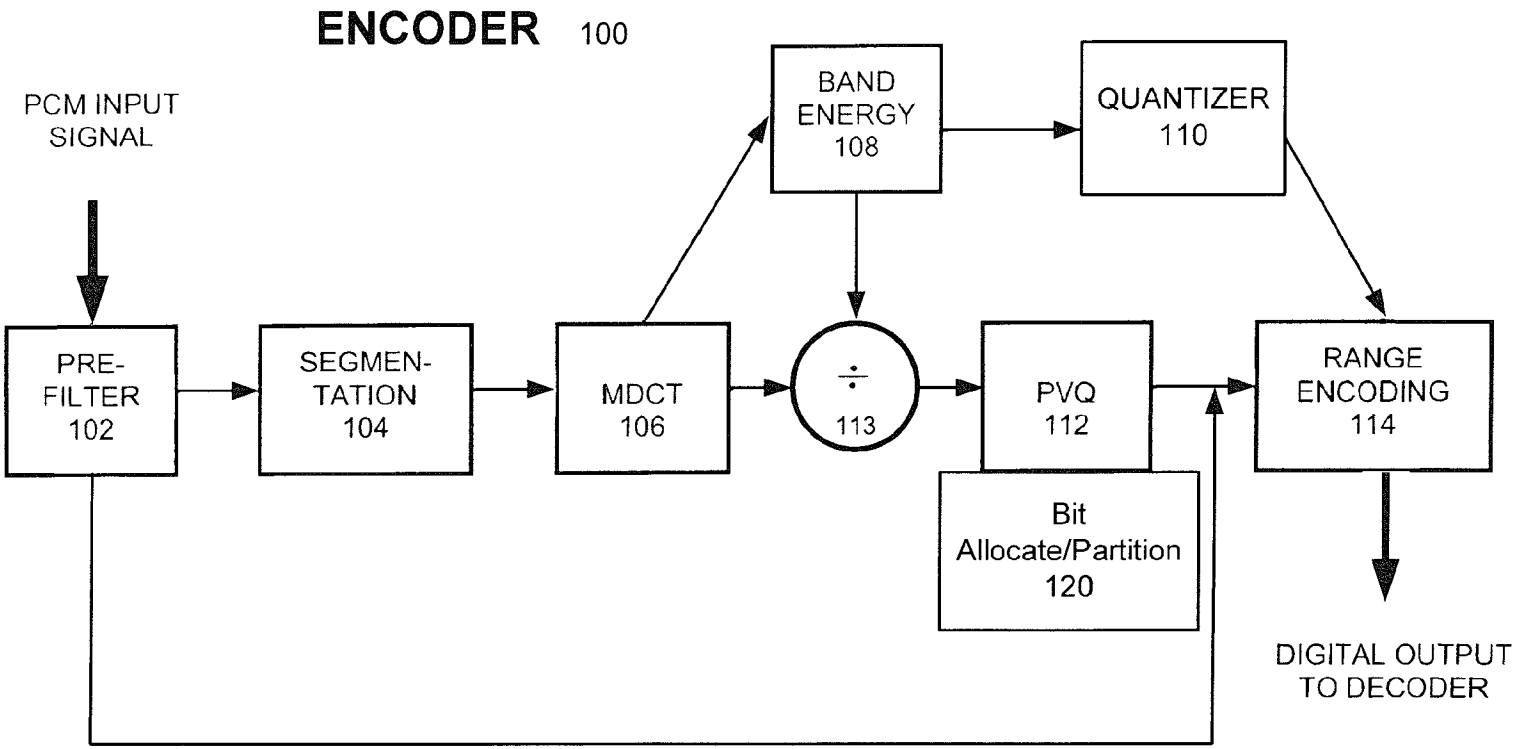
FIG. 1 is a diagram of an encoder circuit that implements a bit allocation and band partitioning scheme in an audio coding system, under an embodiment.

Embodiments are directed to an audio coding scheme implemented in a codec (coder-decoder) system. FIG. 1 is a diagram of an encoder circuit that implements a bit allocation and band partitioning scheme in an audio coding system, under an embodiment. The encoder 100 is a transform codec circuit based on the modified discrete cosine transform (MDCT) using a codebook for transform coefficients in the frequency domain. The input signal is a pulse-code modulated (PCM) signal that is input to a pre-filter stage 102. The PCM coded input signal is segmented into relatively small overlapping blocks by segmentation component 104. The block-segmented signal is input to the MDCT function 106 and transformed to frequency coefficients through an MDCT function. Different block sizes can be selected depending on application requirements and constraints. For example, short block sizes allow for low latency, but may cause a decrease in frequency resolution. The frequency coefficients are grouped to resemble the critical bands of the human auditory system. The entire amount of energy of each group is analyzed in band energy component 108, and the values quantized in quantizer 110 for data reduction. The quantized energy values are compressed through prediction by transmitting only the difference to the predicted values (delta encoding). The unquantized band energy values are removed from the raw DCT coefficients (normalization) in function 113. The coefficients of the resulting residual signal (the so-called "band shape") are coded by Pyramid Vector Quantization (PVQ) block 112. PVQ is a form of spherical vector quantization using the lattice points of a pyramidal shape in multidimensional space as the quantizer codebook for quickly and efficiently quantizing Laplacian-like data, such as data generated by transforms or subband filters. This encoding process produces code words of fixed (predictable) length, which in turn enables robustness against bit errors and removes any need for entropy encoding. The output of the encoder is coded into a single bitstream by a range encoder 114. The bitstream output from the range encoder 114 is then transmitted to the decoder circuit.

In an embodiment, and in connection with the PVQ function 112, the encoder 100 uses a technique known as band folding, which delivers a similar effect to the spectral band replication by reusing coefficients of lower bands for higher bands, while also reducing algorithmic delay and computational complexity.

Figure 2:
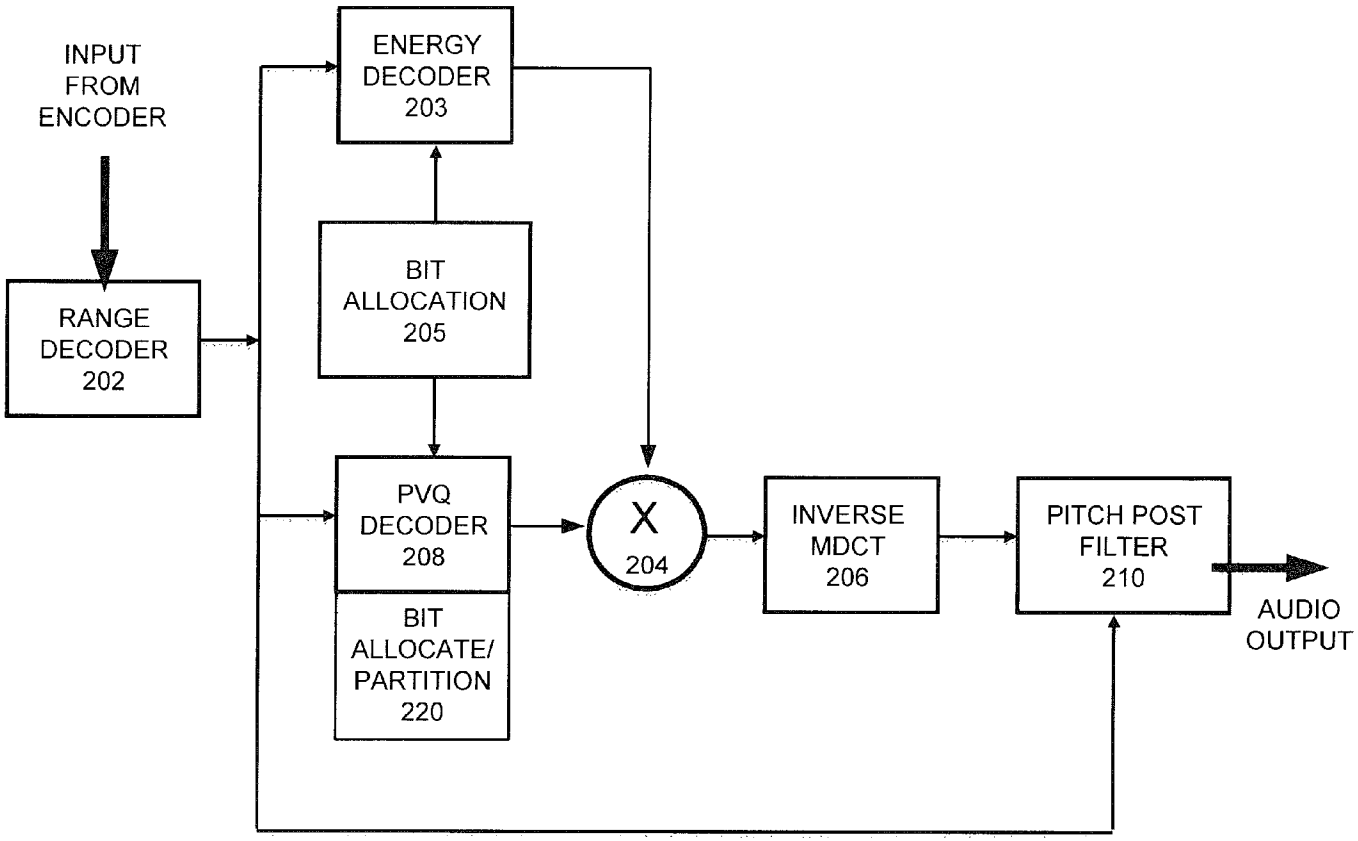
FIG. 2 is a diagram of a decoder circuit that implements a bit allocation and band partitioning scheme in an audio coding system, under an embodiment.

FIG. 2 is a block diagram of a decoder circuit for use in an audio coding system that includes a dynamic coefficient spreading mechanism, under an embodiment. The decoder 200 receives the encoded data from the encoder and processes the input signal through a range decoder 202. From the range decoder 202, the signal is passed through an energy decoder 203 and a PVQ decoder 208, and to pitch post filter 210. The values from PVQ decoder 208 are multiplied to the band shape coefficients by function 204, and then transformed back to PCM data through inverse MDCT function 206. The individual blocks may be rejoined using weighted overlap-add (WOLA) in a folding block. Many parameters are not explicitly coded, but instead are reconstructed using the same functions as the encoder. The decoded signal is then processed through a pitch post filter 210 and output to an audio output circuit, such as audio speaker(s). In the embodiment of FIG. 2, a bit allocation and partitioning function 220 that is incorporated as part of PVQ 112 provides the bit allocation and partitioning functions described herein. A separate bit allocation block 205 provides bit allocation data to the energy decoder 203 and PVQ decoder 208. A similar bit allocation block may be provided on the encoder side between quantizer 110 and PVQ 112 for symmetry between the encoder and decoder.

In an embodiment, the codec represented by FIG. 1 and FIG. 2 may be an audio codec, such as the CELT (Constrained Energy Lapped Transform) codec developed by the Xiph.Org Foundation. It should be noted, however, that any similar codec might be used.

For the embodiment of FIGS. 1 and 2, an input audio signal is mapped from the time domain into a set of frequency domain coefficients, using a transform function. This function may be either a transform with a fixed resolution across all frequencies, such as the Modified Discrete Cosine Transform (MDCT), or one with variable time-frequency (TF) resolution. An example of a variable time-frequency resolution scheme is described in U.S. Patent Application No. 61/384,154, which is hereby incorporated by reference in its entirety.

Embodiments of the codec circuits of FIGS. 1 and 2 are used to implement a signal compression system that employs gain shape vector quantization methods. A vector quantization method comprises passing signal vectors of a codebook through a synthesis filter to reproduce signals and using error values between the reproduced signals and the input signal in order to determine the index of a signal vector having the smallest error. In gain shape vector quantization, a vector can be expressed in terms of a gain and a shape, which is a unit norm vector that can be coded using a codebook with unit norm vectors. The gain and shape can be quantized separately using some respective number of bits so that either the gain or shape is more accurately represented.

Embodiments of the signal processing systems and methods described herein implement methods for bit allocation and band partitioning for use in an audio codec based on gain-shape vector quantization. In certain audio applications, these methods allow for the practical adaptation of bit rates from 32 kbps to 255 kbps per channel and latencies of 5 ms or less up to more than 20 ms. The system uses an implicit-dynamic scheme to allow an encoder and decoder both to recreate a series of bit allocation decisions without requiring the transmission of additional side information. Each of the encoder 100 and decoder 200 stages executes a respective bit allocation and partitioning process 120 and 220 to determine appropriate bit allocations for the gain and shape values of the audio signal.

In an embodiment of the audio codec system, as shown in FIGS. 1 and 2, the input PCM signal is partitioned into (possibly overlapping) frames, each of which may contain one or more blocks that are transformed to frequency coefficients through an MDCT (or similar) function. After transformation to the frequency domain, the frequency coefficients are grouped into a number of bands, whose size may vary to match properties of the human ear. This accounts for psycho acoustic effects associated with audio signal processing. Each band may further group coefficients into tiles, where each tile contains coefficients from that band corresponding to a single block. The bands are then quantized, coded, and transmitted to the decoder 200, and may possibly undergo time-frequency (TF)-resolution changes (such as described in U.S. Patent App. No. 61/384,154).

Figure 3:
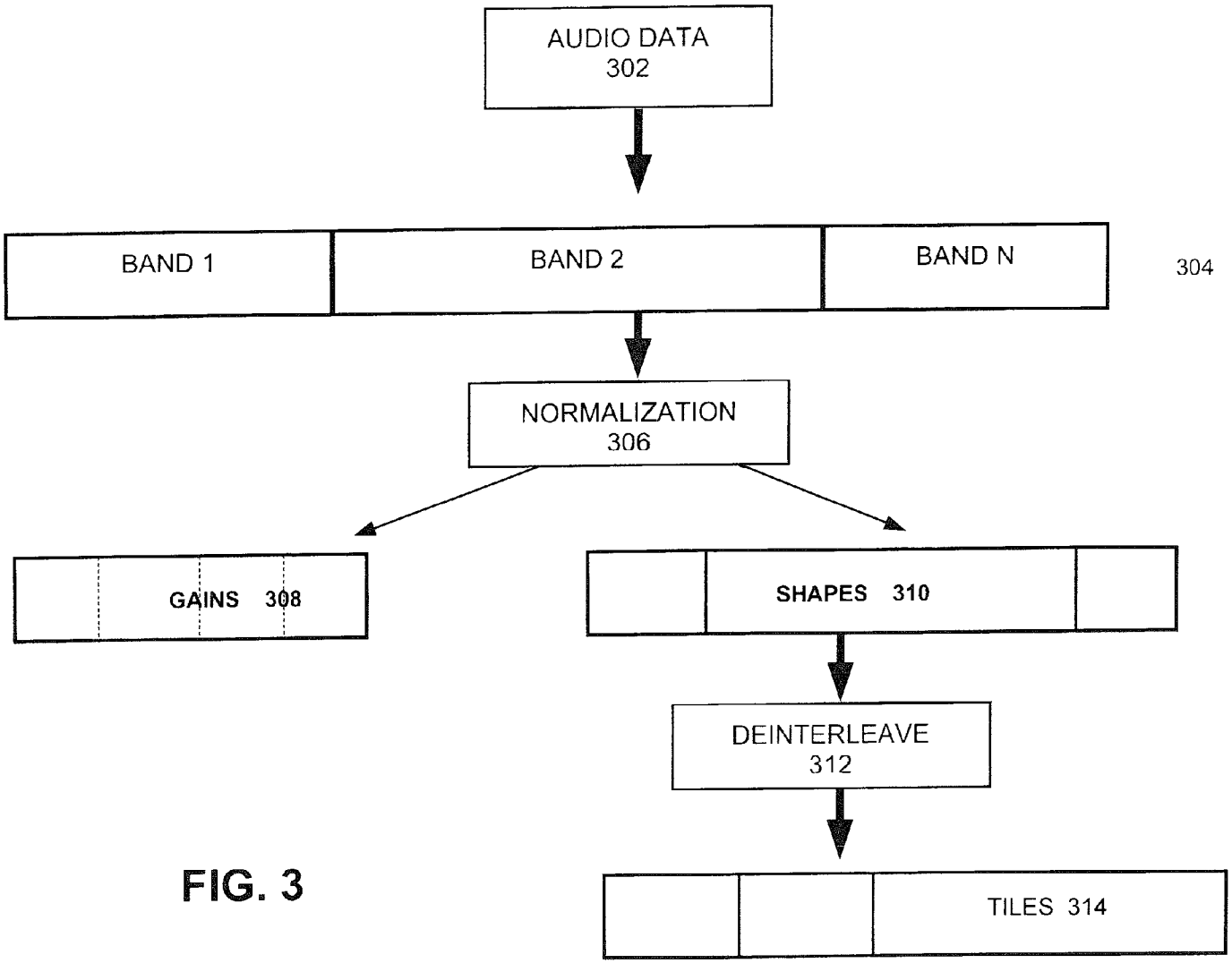
FIG. 3 is a diagram that illustrates the partitioning of audio bands into gain and shape units for use with a bit allocation and partitioning scheme in a gain shape vector quantization coding system, under an embodiment.

FIG. 3 is a diagram that illustrates the partitioning of audio bands into subsequent units for use with a bit allocation and partitioning scheme in a gain shape vector quantization coding system, under an embodiment. Under an embodiment, coefficients representing the audio content 302 are partitioned into one or more of bands 304, whose size may vary to match properties of the human ear. These coefficients may be the output of any appropriate process, such as a time-domain filtering operation, the excitation of an LPC (Linear Predictive Coding) model, the result of a subband filterbank such as the MDCT, or a combination of these processes, or the result of some other processing. As shown in FIG. 3, the bands 304 are processed through a normalization process 306 so that each band y is divided into a gain 308, g, and a shape 310, x, where $y=g\cdot x$ and $\|x\|=1$ under some norm, such as the $L^2$ norm.

The codec system under an embodiment includes a gain-shape allocation function that determines the number of bits to allocate to coding the gain versus the number of bits to code the shape. Essentially the system determines the size of the codebook to be used for the gain (bit rate) and then uses the remaining bits to code the shape. After coding an initial set of parameters, such as flags to set the operating mode, transform sizes, filtering parameters, a coarse representation of the gains, or other side information, any remaining bits in the packet are distributed to the individual bands. The exact method of distributing bits to bands is usually based on psychoacoustic principles, which are well-known in the art, and depend on the specific representation of audio content being used, and may additionally benefit from a small amount of side information to adapt to the signal being coded.

Once bits have been allocated to a particular band, they must be partitioned between the scalar gain quantizer and the vector shape quantizer of dimension N−1. It is assumed that $N\geq 2$, since if N=1, the "shape" consists of, at most, a single sign bit, and all the remaining bits should go to the gain. Given the number of dimensions N and the target bitrate b, one can find the allocation that minimizes the mean squared error (MSE) introduced by the quantization, using known methods. For example, one known method derives this allocation under the assumptions that the gain is quantized using an A-law quantizer and the shape is quantized using an optimal spherical quantizer (for which there is no known construction for arbitrary dimension) and that the bitrate b is large. The result for the size of the codebook to use for the gain, $N_g$, is given in Eq. 1 as follows:

$$N_g = \left((N-1)\frac{C_g}{C_{svq}}\right)^{\frac{N-1}{2N}} 2^{\frac{b}{N}}, \tag{1}$$

where $C_g$ is a constant that depends on the A-law quantizer parameter, but not N or b. The value of $C_{svq}$ is:

$$C_{svq} = \frac{N-1}{N+1}\left(\frac{2\sqrt{\pi}\,\Gamma\left(\frac{N+1}{2}\right)}{\Gamma\left(\frac{N}{2}\right)}\right)^{\frac{2}{N-1}} \tag{2}$$

As can be seen, the expression based on $N_g$ and $C_{svq}$ is quite complicated, and requires several processor-intensive division operations, as well as the evaluation of several transcendental functions. In addition, the result that is desired is $\log_2 N_g$, which is the number of bits to use, and not $N_g$, itself, further complicating the situation. As such, these calculations are not particularly well suited for implementation on low-powered DSP processors, such as may be found in many commercial audio compression systems. In addition, the assumption that b is large gives suboptimal results when b is in fact small, as is often the case for low-bitrate audio coding.

In an embodiment, a gain-shape allocation method utilizes an approximation method to simplify the gain shape bit allocation calculations in order to simplify the processing operations. The process applies an approximation function for large factorials (e.g., Stirling's approximation) to Eq. (2) above to produce the following expression:

$$C_{svq} \approx \frac{(N-1)^2}{(N+1)(N-2)}\left(\frac{2\pi}{e(N-1)}\right)^{\frac{1}{N-1}} \tag{3}$$

In above Eq. 3, the value, $C_{svq}$ rapidly approaches 1 as N becomes large. Substituting the value 1 into Eq. 1 for $C_{svq}$ and replacing (N−1) with N (which compensates for undershooting $C_{svq}$ for small N) produces the following:

$$N_g \approx \sqrt{C_g N}\, 2^{b/N}, \tag{4}$$

which is moderately accurate for N>2. This gives the bit allocation for the gain, $b_g$, (in bits) as:

$$b_g = \log_2 N_g \approx \frac{b}{N} + \frac{1}{2}\log_2 C_g + \frac{1}{2}\log_2 N \tag{5}$$

In an embodiment, the bit allocation for the gain is actually computed via the expression:

$$b_g(\alpha) = \begin{cases} \frac{b}{N} + G_2 + \alpha\log_2 N, & N = 2, \\ \frac{b}{N} + G + \alpha\log_2 N, & N > 2, \end{cases} \tag{6}$$

In the above Eq. 6, the values G and $G_2$ are experimentally chosen constants (selected to be close to ½ $\log_2 C_g$ and G+N/2, respectively), and a is a low-rate correction factor determined as follows:

$$\alpha = \begin{cases} \frac{3}{4}, & b_g\left(\frac{1}{2}\right) < 2, \\ \frac{5}{8}, & b_g\left(\frac{1}{2}\right) < 3, \\ \frac{1}{2}, & b_g\left(\frac{1}{2}\right) \geq 3. \end{cases} \tag{7}$$

Given suitably chosen values of $G_2$ and G, this comes quite close to minimizing the mean square error (MSE) over a large range of values of N and b, but is much simpler to compute than Eq. 1. In a practical codec, one cannot use negative bits, and the codebook size may be limited to various sizes (such as a whole number of bits), subject to some maximum, $b_g^{max}$. Thus in a preferred embodiment, the actual size of the codebook is determined as given in Eq. 8, as follows:

$$b_g = \max\left(0, \min\left(\left[b_g(\alpha) + \frac{1}{2}\right], b_g^{max}\right)\right) \quad (8)$$

The above Eq. 8 rounds the calculated number of bits for gain to an integer number of bits, as well as imposes bounds on the possible value and prevents the possibility of negative bits.

In an embodiment, the constants G and $G_2$ can be chosen experimentally by an offline training procedure. This procedure first collects a large number of training vectors to be quantized, and measures the average MSE after quantizing at every supported combination of gain quantizer bitrate and shape quantizer bitrate. For a given target bitrate and for each supported gain quantizer bitrate, the process finds the largest shape quantizer bitrate that yields a total less than the target, and the smallest shape quantizer bitrate that yields a total greater than the target, and uses these to interpolate an average MSE value at the target bitrate. Finally, the process selects the gain quantizer bitrate that minimizes this interpolated MSE for the target bitrate. The process is repeated with N=2 for all desired bitrate targets and picks the value of $G_2$ that minimizes the mismatch between the decisions made by this process and those made by Eq. 8. The process then repeats with all supported N>2 for all desired bitrate targets, and picks the value of G that minimizes the mismatch between the decisions made by this process and those made by Eq. 8. The roles of gain and shape can be reversed in this process, but there are typically fewer supported gain bitrates than shape bitrates, which can make this option less efficient.

Once the number of bits $b_g$ for the gain is determined, a simple subtraction step is used to determine the number of bits to allocate to the shape $b_s$. In this case, the remaining $b_s=b-b_g$ bits are allocated to the shape. In practice, Eq. 8 may be approximated using fixed-point integer arithmetic. The equation requires only a single division and a single logarithm calculation, both of which can be accelerated through the use of a small lookup table.

Once the number of bits to be allocated respectively to the gain ($b_g$) and shape ($b_s$) have been determined, the normalized coefficients of an entire band that comprise the "shape," are quantized. Ideally, the normalized coefficients of an entire band, which compose the shape would be quantized with a single vector quantizer, but in practice efficient vector quantizers with codewords larger than the size of a typical microprocessor word, e.g., 32 bits, are difficult to implement. That is, the number of bits allocated for the shape may be on the order of hundreds of bits, but such a codebook would be too big for practical purposes. To address this issue, the process undertakes a band partitioning and allocation procedure. Algebraic codebooks such as the Pyramid Vector Quantizer are an ideal choice for a vector quantizer when a large number of band sizes, N, and bit rates $b_s$, must be supported. They can be implemented for sizes larger than 32 bits using multiple-precision arithmetic, but this has a large cost in terms of computation time, code size, and data size. The following described method of band partitioning and allocation generally works with any suitable vector quantizer, but the Pyramid Vector Quantizer is used in a preferred embodiment.

To maintain processing efficiency, when a band is allocated more than a certain number of bits for the shape, it is recursively split into halves (partitioned) until the allocation for each partition becomes small enough to code with a single vector quantization codeword, or until the maximum partition depth is reached. The exact number of bits required to trigger a split may vary from band to band, or even among the partitions within a band. In a preferred embodiment, a threshold is set a constant amount above the largest codebook size for the current partition (usually close to 32 bits, but sometimes significantly smaller), and it is only split into two more partitions if the target allocation exceeds this amount. Because splitting reduces the VQ (vector quantization) dimension of the codebooks used, it adds some small amount of coding inefficiency, and the constant amount added to the threshold helps compensate for this overhead by avoiding splitting when the increased bit allocation would not result in lower distortion. Alternative embodiments may utilize other splitting rules, like splitting when the allocation exceeds a fixed threshold (such as 32 bits), which is simpler to implement and reduces compression performance only by a very tiny amount.

If x is the input to the splitting process (either a whole band, or a single partition that has already been split at least once), then it is split into two pieces $y_1$ and $y_2$, such that x is the concatenation of $y_1$ and $y_2$. These are again separated into gains, $g_1$ and $g_2$, and shapes, $x_1$ and $x_2$, such that $y_1=g_1x_1$ and $y_2=g_2x_2$ and $\|x_1\|=\|x_2\|=1$. The relative magnitude of the two partitions is coded using a scalar parameter $\theta=\arctan(g_2/g_1)$, in the range $[0, \pi/2]$. Given these parameters, the codec must determine the optimal bit allocations for $\theta$, $x_1$, and $x_2$, denoted $b_\theta$, $b_1$, and $b_2$, respectively. The value $\theta$ represents the ratio of the gains, and $x_1$, and $x_2$ are the normalized shapes that are generated after factoring out the gains from $y_1$ and $y_2$.

The normalized coefficients in a band may be further grouped into one or more tiles (after possible deinterleaving or other reordering), where each tile contains coefficients from distinct periods of time. Thus, as shown with reference to FIG. 3, the normalized shape coefficients 310 are grouped into tiles 314 after deinterleaving process 312. These tiles 314 may vary in size, and in the preferred embodiment the size of each tile may vary from band to band, though all the tiles within a band are the same size. It is not necessary that the basis functions corresponding to coefficients within an individual tile be exactly zero outside of the time period that tile correspond to, but minimizing their magnitude outside this period avoids leakage and reduces the occurrence of pre-echo artifacts. Knowledge of the tile groupings does not affect the partitioning process, and a partition may contain several tiles, a single tile, or part of a single tile. However the tile groupings do affect the optimal bit allocation, which attempts to take into account temporal masking.

Figure 4:
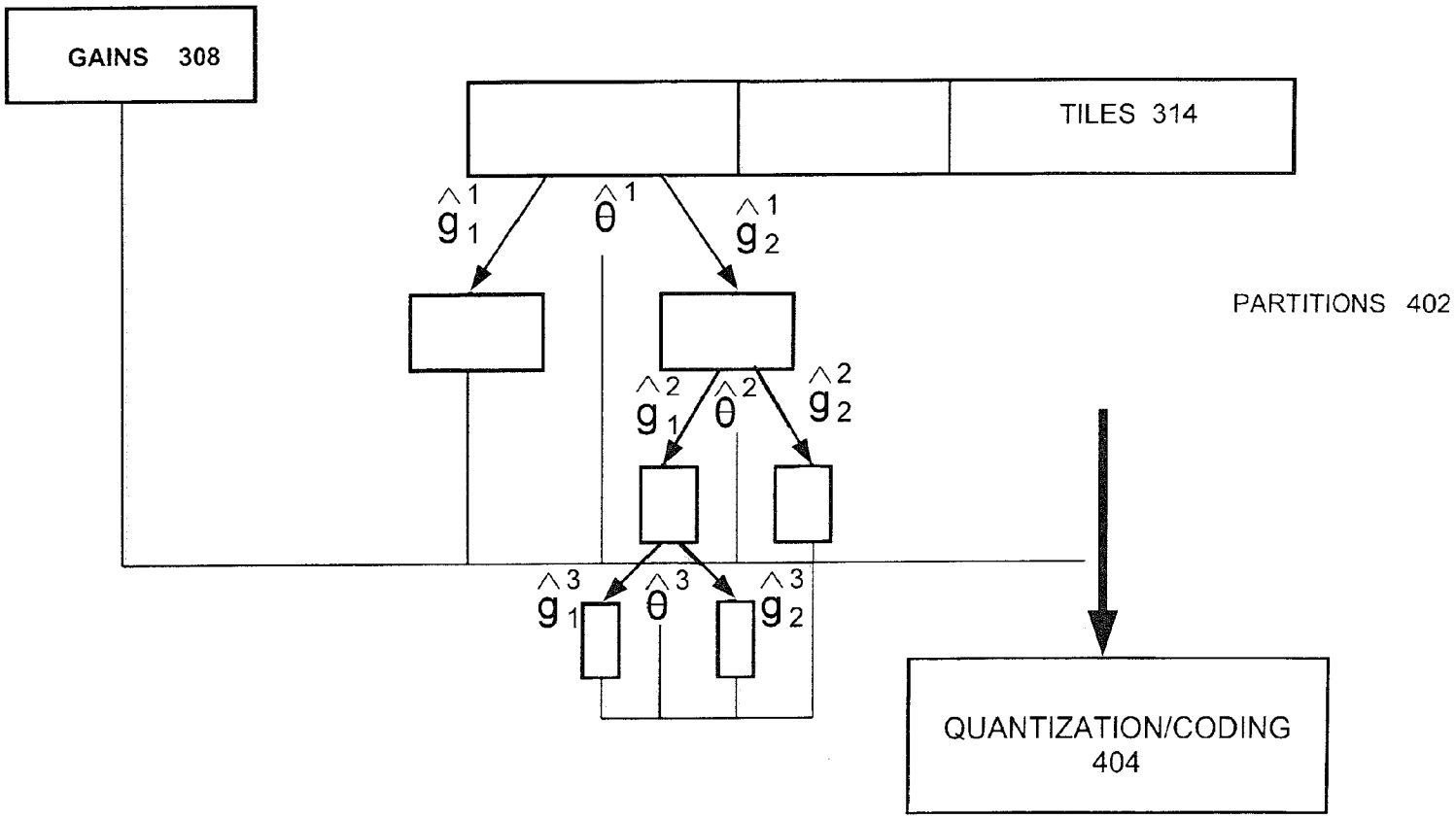
FIG. 4 is a diagram that illustrates the iterative splitting of shape units to match codebook size, under an embodiment.

FIG. 4 is a diagram that illustrates the iterative splitting of shape units to match codebook size, under an embodiment. As shown in FIG. 4, the tiles 314 of the normalized shape coefficients are successively split into partitions 402 until the allocation for each partition becomes small enough to code with a single vector quantization codeword. Quantized values of $\theta$, $g_1$, and $g_2$, denoted $\hat{\theta}$, $g_1$ , and $g_2$, respectively are generated for each partition. These values, along with the gains 308 are processed by quantization/coding stage 404.

In an embodiment, a bit allocation process is used to determine the optimal bit allocations for $\theta$, $x_1$, and $x_2$. In this process, $b_p$ is denoted as the current allocation for the band, e.g., either $b_s$ if the entire band is being partitioned, or $b_1$ or $b_2$ from a previous round of partitioning. Following a process similar to that used for Eq. 8, above, the target allocation for $\theta$ in terms of the total allocation for the current partition, $b_p$, and the size of each partition after splitting, $N_p$, is determined by the following Eq. 9:

$$b_\theta = \frac{b_p}{2N_p - 1} + S + \frac{1}{2}\log_2 N_p \tag{9}$$

In the above Eq. 9, S is an experimentally determined constant. As before, a practical implementation will need to map this allocation to a real codebook for θ. It is possible to derive a number of alternatives for this procedure, and use it to produce a quantized θ value, $\hat{\theta}$. For example, in the preferred embodiment, the allocation is capped at a maximum value, $b_\theta^{max}$, and the codebook size is computed from an integer approximation of Eq. 9 using $1/8^{th}$ bit precision. A preferred embodiment actually codes $\hat{\theta}$ using a range coder, which allows codebooks that do not use a whole number of bits. For partitions that contain data from more than one tile, the process uses a uniform probability distribution function (PDF) to drive the range coder, while for partitions that contain data only from a single tile, it uses a triangular PDF. Many other coding schemes of varying complexity and compression performance are also possible. Because these coding schemes can use a variable number of bits, a fixed-point estimate of the actual number of bits used, $b_{\hat{\theta}}$ is subtracted from the total allocation $b_p$, instead of the original target allocation.

The allocation for the two partitions $x_1$ and $x_2$ is determined, in turn, as given in Eqs. 10 and 11:

$$b_1 = \frac{b_p - b_{\hat{\theta}} - \delta(\hat{\theta})T_\delta}{2}, \tag{10}$$

$$b_2 = b_p - b_{\hat{\theta}} - b_1, \tag{11}$$

where $$\delta(\hat{\theta}) = (N-1)\log_2 \tan\hat{\theta}, \tag{12}$$

In the above Eq. 12, $T_\delta$ is a temporal masking offset, computed according to psychoacoustic principals. In a preferred embodiment, when the total number of tiles on both sides of the partition, t, is greater than 1, then $$T_\delta = \begin{cases} \max\left(\frac{tN}{8}, -\delta(\hat{\theta})\right), & \hat{\theta} \le \frac{\pi}{4}, \\ -\frac{t\delta(\hat{\theta})}{32}, & \hat{\theta} > \frac{\pi}{4}, \end{cases} \tag{13}$$

Otherwise $T_\delta=0$. Different values depending on the sampling rates, tile sizes, and other factors may also be used as appropriate, depending on the constraints and requirements of the system.

In the decoder 200, dequantized versions of the original gains may be recovered as shown in Eq. 14:

$$\hat{g}_1 = \frac{\cos\hat{\theta}}{\left\|\left\{\cos\hat{\theta}, \sin\hat{\theta}\right\}^T\right\|}, \hat{g}_2 = \frac{\sin\hat{\theta}}{\left\|\left\{\cos\hat{\theta}, \sin\hat{\theta}\right\}^T\right\|}, \tag{14}$$

When the $L^2$ norm is used, the denominators are 1. A practical implementation will use an integer approximation to $\cos\hat{\theta}$ and $\sin\hat{\theta}$, in order to use them for computing $\log_2\tan\hat{\theta}$ in Eq. 12 (also using an integer approximation), which must produce exactly the same value in the encoder and the decoder.

As shown in FIGS. 1 and 2, each of the encoder 100 and decoder 200 circuits includes a respective bit allocation/partitioning process 120 and 220. These processes determine and generate the appropriate signals for the coding and allocation of bits for the gain and shape parameters. In an embodiment, process 120 of the encoder is incorporated in the encoder side PVQ function 112 and makes the bit allocation decisions and transmits symbols using codebooks that are sized to take up the appropriate number of bits. These symbols are then sent in a packet to the decoder 200. The bit allocation/processing component 220 of the decoder 200 reads the symbols and repeats the same calculations as performed in process 120 to determine the size of the codebook to use to read the symbols that follow in the packet. Thus, the encoder determines the number of bits to use for θ and sends the quantized value using the requisite number of bits. The decoder reads θ and figures out from its value the number of bits to use for the quantized values of $x_1$ and $x_2$ using Eqs. 10 and 11.

Figure 5:
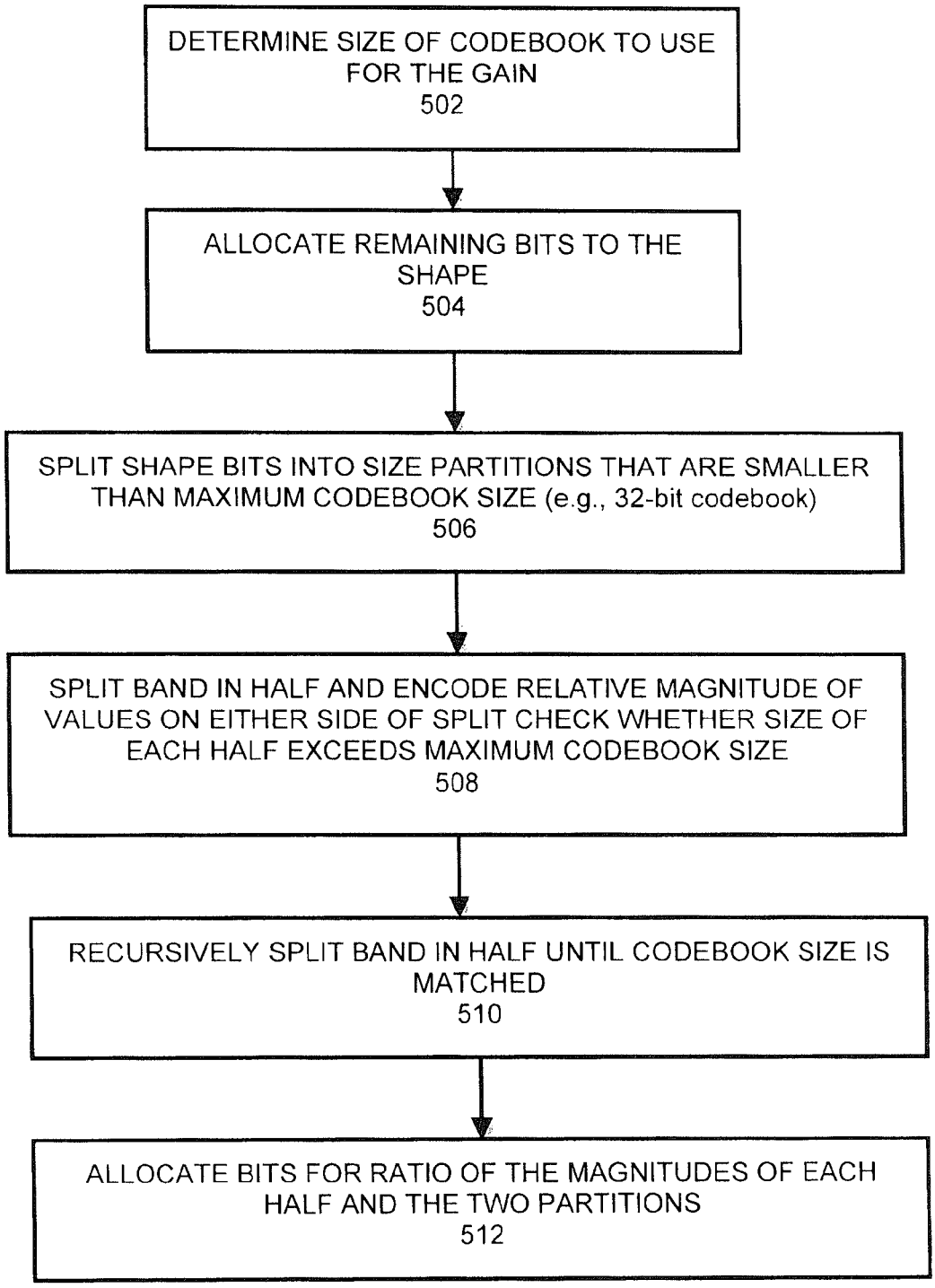
FIG. 5 is a flowchart that illustrates a method of performing bit allocation in a gain shape vector quantization coding system, under an embodiment.

FIG. 5 is a flowchart that illustrates an overall method of performing bit allocation in a gain shape vector quantization coding system, under an embodiment. The overall process begins with act 502, which determines the size of the codebook to use for the gain, such as determined using Eq. 8. The remaining bits are then allocated to the shape by the simple operation, $b_s=b-b_g$, act 504. In a practical implementation, the number of bits allocated to the shape may exceed the practical codebook size (e.g., 32 bits). In this case, the band is split into partitions that are smaller than the maximum codebook size, act 506. The first split operation creates two half bands or partitions. The relative magnitude of values on either side of the split are encoded and the process then determines whether the size of each partition exceeds the maximum codebook size, act 508. If the first split does not generate sufficiently small partitions, the splitting process is executed recursively until the appropriate codebook size is reached, act 510. The allocation of bits for the ratio of the magnitudes of each half, θ, and the two partitions, $x_1$ and $x_2$, are then allocated.

Because of the practical restrictions on the size of various codebooks, a partition 402, as shown in FIG. 4 may not use all of its allocated bits. In order to reduce the waste incurred by not using the entire allocation, these bits may be redistributed to subsequent partitions, and even subsequent bands. To maximize the effectiveness of the redistribution, the described method may employ a rebalancing technique to code the larger of the two partitions in each split (the one allocated the greater number of bits) first, followed by the smaller one, after possibly adjusting its allocation to use some or all of the bits the first one failed to use. Bits unused during shape coding may also be redistributed for improving the precision of the gains.

Although embodiments have been described in relation to processing audio signals using an audio codec, it should be understood that the methods and systems described herein can also be implemented to process video signals to using a video codec. In this case, the input signal may be a digitized video signal that is organized such that the frequency coefficients are grouped into a number of bands, whose size may vary to match properties of the human eye to account for the psycho visual effects associated with video signal processing. Appropriate changes may be made to the values of certain variables in the equations shown above, depending on the characteristics of the video signal and the requirements of the video codec components.

Embodiments are directed to a method and system of coding an audio signal using gain-shape vector quantization, comprising: organizing coefficients representing audio content into one or more bands; dividing each band into a gain and a shape; determining, in processor-based device processing the audio content, a size of a codebook to use for the shape using an approximation method, wherein the size of the codebook dictates a number of bits to allocate to the size; subtracting, in the processor-based device, the number of bits allocated to the size from a total number of bits to determine a number of bits to allocate to the shape; determining if the number of bits allocated to the shape is less than a defined number of bits used in the codebook; and recursively dividing the band into equal size partitions until the number of bits allocated to the shape in each partition is less than the defined number.

Embodiments are further directed to a method and system of coding an audio signal using gain-shape vector quantization, comprising: organizing coefficients representing audio content into one or more bands; dividing each band into a gain and a shape; quantizing the gain using an A-law quantizer, and quantizing the shape using an optimal spherical quantizer; determining, in processor-based device processing the audio content, a size of a codebook to use for the shape using an approximation method for large factorials that approximates the size of the codebook to use for the gain, wherein the size of the codebook dictates a number of bits to allocate to the size; and subtracting, in the processor-based device, the number bits allocated to the size from a total number of bits to determine a number of bits to allocate to the shape.

For purposes of the present description, the terms "component," "module," and "process," may be used interchangeably to refer to a processing unit that performs a particular function and that may be implemented through computer program code (software), digital or analog circuitry, computer firmware, or any combination thereof.

It should be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A computer-implemented method of coding an audio signal using gain-shape vector quantization, comprising:

organizing coefficients representing audio content into one or more bands;

dividing each band into a gain and a shape;

determining, in a processor-based device processing the audio content, a number of bits to use for the gain using an approximation method, wherein a size of a codebook dictates a total number of bits to allocate between the gain and the shape;

subtracting, in the processor-based device, the number of bits allocated to the gain from the total number of bits to determine a number of bits to allocate to the shape;

determining if the number of bits allocated to the shape is less than a defined maximum number of bits used in the codebook; and recursively dividing the band into substantially equal size partitions until the number of bits allocated to the shape in each partition is less than the defined number.

2. The method of claim 1 wherein the coefficients are generated by a process selected from the group consisting of: time-domain filtering, excitation of a Linear Predictive Coding (LPC) model, a subband filter process, and a modified discrete cosine transform function.

3. The method of claim 2 wherein the one or more bands are selected to be of a size that matches one or more properties of human hearing.

4. The method of claim 1 wherein the codebook comprises an algebraic codebook, and wherein the defined number of bits comprises 32 bits.

5. The method of claim 4 wherein the processor-based device comprises an audio codec having an encoder circuit and a decoder circuit.

6. The method of claim 5 wherein the encoder circuit executes an encoder process that makes a series of bit allocation decisions for the gain and the shape of the audio content, and wherein the decoder circuit executes a decoder process that recreates the series of bit allocation decisions for gain and shape, without requiring transmission of additional side information for each decision in any data packet transmitted between the encoder circuit and the decoder circuit.

7. The method of claim 1 wherein the gain is quantized using an A-law quantizer, and the shape is quantized using an optimal spherical quantizer, and wherein the approximation comprises an approximation for large factorials that approximates the size of the codebook to use for the gain, denoted $N_g$, as: $N_g \approx \sqrt{C_g N} 2^{b/N}$, wherein N is a number of dimensions, b is a target bitrate, and $C_g$ is a defined constant that depends on the A-law quantizer parameter.

8. The method of claim 7 wherein the number of bits allocated for the gain is denoted $b_g$, and is calculated using the formula: $b_g = \log_2 N_g$.

9. The method of claim 8 further comprising determining the number of bits allocated for the gain using a low bitrate correction factor.

10. A computer-implemented method of coding an audio signal using gain-shape vector quantization, comprising:

organizing coefficients representing audio content into one or more bands;

dividing each band into a gain and a shape;

determining, in processor-based device processing the audio content, a number of bits to use for the gain using an approximation method for large factorials that approximates a size of a codebook to use for the gain, wherein the size of the codebook dictates a total number of bits to allocate between the gain and the shape;

subtracting, in the processor-based device, the number bits allocated to the gain from the total number of bits to determine a number of bits to allocate to the shape; and quantizing the gain using an A-law quantizer, and quantizing the shape using an optimal spherical quantizer.

11. The method of claim 10 further comprising:

determining if the number of bits allocated to the shape is less than a defined number of bits used in the codebook; and recursively dividing the band into equal size partitions until the number of bits allocated to the shape in each partition is less than the defined number.

12. The method of claim 11 wherein each partition is separated into gains denoted $g_1$ and $g_2$ and shapes denoted $x_1$ and $x_2$.

13. The method of claim 12 further comprising coding a relative magnitude of two partitions comprising a divided band using a scalar parameter denoted θ, wherein a value of the scalar parameter is calculated by: $\theta=\arctan(g_1/g_2)$.

14. The method of claim 13 wherein the codebook comprises an algebraic codebook, and wherein the defined number of bits comprises 32 bits.

15. The method of claim 14 wherein the processor-based device comprises an audio codec having an encoder circuit and a decoder circuit.

16. The method of claim 15 wherein the encoder circuit executes an encoder process that makes a series of bit allocation decisions for the gain and the shape of the audio content, and wherein the decoder circuit executes a decoder process that recreates the series of bit allocation decisions for gain and shape, without requiring transmission of additional side information for each decision in any data packet transmitted between the encoder circuit and the decoder circuit.

17. A system for coding an audio signal in an audio codec utilizing gain-shape vector quantization, comprising:

a first component organizing coefficients representing audio content into one or more bands and dividing each band into a gain and a shape;

a gain shape allocation component determining a number of bits to use for the gain using an approximation method, wherein the size of the codebook dictates a total number of bits to allocate between the gain and the shape, and subtracting, in the processor-based device, the number bits allocated to the gain from the total number of bits to determine a number of bits to allocate to the shape; and a band partitioning and allocation component determining if the number of bits allocated to the shape is less than a defined maximum number of bits used in the codebook, and recursively dividing the band into substantially equal size partitions until the number of bits allocated to the shape in each partition is less than the defined number.

18. The system of claim 17 wherein the coefficients are generated by a process selected from the group consisting of: time-domain filtering, excitation of a Linear Predictive Coding (LPC) model, a subband filter process, and a modified discrete cosine transform function.

19. The system of claim 18 wherein the codebook comprises an algebraic codebook, and wherein the defined number of bits comprises 32 bits.

20. The system of claim 19 wherein the system includes an audio codec having an encoder circuit and a decoder circuit, wherein the encoder circuit executes an encoder process that makes a series of bit allocation decisions for the gain and the shape of the audio content, and wherein the decoder circuit executes a decoder process that recreates the series of bit allocation decisions for gain and shape, without requiring transmission of additional side information for each decision in any data packet transmitted between the encoder circuit and the decoder circuit.

21. The system of claim 17 wherein the gain is quantized using an A-law quantizer, and the shape is quantized using an optimal spherical quantizer, and wherein the approximation comprises an approximation for large factorials that approximates the size of the codebook to use for the gain.

* * * * *